US009150340B2

(12) United States Patent
Pawlik

(10) Patent No.: US 9,150,340 B2
(45) Date of Patent: Oct. 6, 2015

(54) CHILD-RESISTANT CONTAINER WITH HINGED CLOSURE

(71) Applicant: Jorg Pawlik, Toronto (CA)

(72) Inventor: Jorg Pawlik, Toronto (CA)

( * ) Notice: Subject to any disclaimer, the term of this patent is extended or adjusted under 35 U.S.C. 154(b) by 0 days.

(21) Appl. No.: 13/783,285

(22) Filed: Mar. 2, 2013

(65) Prior Publication Data

US 2014/0246433 A1 Sep. 4, 2014

(51) Int. Cl.

| | |
|---|---|
| ***B65D 39/00*** | (2006.01) |
| ***B65D 55/02*** | (2006.01) |
| ***B65D 43/14*** | (2006.01) |
| ***B65D 50/06*** | (2006.01) |

(52) U.S. Cl.
CPC ..... *B65D 50/066* (2013.01)

(58) Field of Classification Search
CPC ..... B65D 2251/105; B65D 47/0842; B65D 50/046; A61J 1/03
USPC ..... 215/39, 331, 306, 334, 335, 339, 340, 215/237, 217, 235; 220/282, 790, 843, 845, 220/797, 802, 805, 836, 837, 375, 254.3, 220/254.8
See application file for complete search history.

(56) References Cited

U.S. PATENT DOCUMENTS

| | | | | |
|---|---|---|---|---|
| 3,858,740 | A * | 1/1975 | Lestaevel | 215/216 |
| 3,986,627 | A * | 10/1976 | Zapp | 215/237 |
| 5,083,671 | A * | 1/1992 | Hayes | 215/245 |
| 5,984,123 | A * | 11/1999 | Mogami et al. | 215/235 |
| 7,073,679 | B1 * | 7/2006 | Lagler et al. | 220/259.1 |
| 7,823,736 | B1 * | 11/2010 | Pugne et al. | 215/235 |
| 2002/0130100 | A1 * | 9/2002 | Smith | 215/247 |
| 2004/0056040 | A1 * | 3/2004 | Ziegler | 220/847 |
| 2005/0023285 | A1 * | 2/2005 | Keung | 220/835 |
| 2009/0095699 | A1 * | 4/2009 | Milante | 215/217 |

* cited by examiner

*Primary Examiner* — Shawn M Braden

(57) ABSTRACT

A child-resistant hinged closure coupled to a container wherein the closure, while securely locked, has freedom of axial rotation but limited freedom of radial displacement with respect to the container. The closure can only be unlocked by radially displacing the closure along a singular axis with respect to the container.

16 Claims, 7 Drawing Sheets

CHILD-RESISTANT CONTAINER WITH HINGED CLOSURE

This application claims priority under 35 U.S.C. Section 119(e) of U.S. Provisional Application No. 61/606,503 filed 5 Mar. 2012, which is expressly incorporated by reference herein.

DESCRIPTION

Background

The present disclosure relates to an assembly comprising a container and a closure with hinged lid, and more particularly to a child-resistant container and closure.

SUMMARY

Objectives and Advantages of the Invention

The primary objective of the present invention is to provide a container and closure, for pills and other hazardous substances, that are both child-resistant and easy to operate, especially by users with impaired dexterity or vision.

It is another objective of the invention to provide a container and child-resistant closure that are simple and inexpensive to manufacture and assemble.

It is a significant advantage of the present invention that upon being re-closed, the child-resistance of the closure is completely restored.

It is a further advantage that the invention can be opened and closed with one hand.

Another advantage of the invention is that it is self-contained with no loose cap to handle.

Principles of Construction and Operation

According to the present disclosure, the invention is an assembly comprising a closure coupled to a necked container wherein the neck of the container has a filling aperture, and the closure comprises a lid hinged to a body.

The closure is coupled axially to the neck of the container by snap-fit without regard to rotational alignment. During assembly, body retainer lugs engage a flange of the neck to prevent subsequent disassembly while still allowing axial rotation about the neck.

A seal is created between the neck and the lid by cooperating elastically deformable sealing members of the neck and lid.

The closure is securely locked to the container by radially engaging a latch of the lid with the flange of the neck.

The closure can selectedly be unlocked by radially displacing the closure sufficiently to disengage the latch from the flange.

The displacement of the closure is allowed primarily by the elastic deformation of the plug, and secondarily by the elastic deformation of the hinge side of the body.

The displacement of the closure is constrained to a singular axis aligned from the hinge to the latch.

If the closure is lifted during an unlocking attempt, displacement of the closure is prevented by the interference of an interlock member of the body and the flange.

The unlocked closure can selectedly be relocked by pressing the lid down against the body to re-engage the latch and flange.

BRIEF DESCRIPTION OF THE DRAWINGS

The detailed description particularly refers to the accompanying figures in which.

Figure 1:
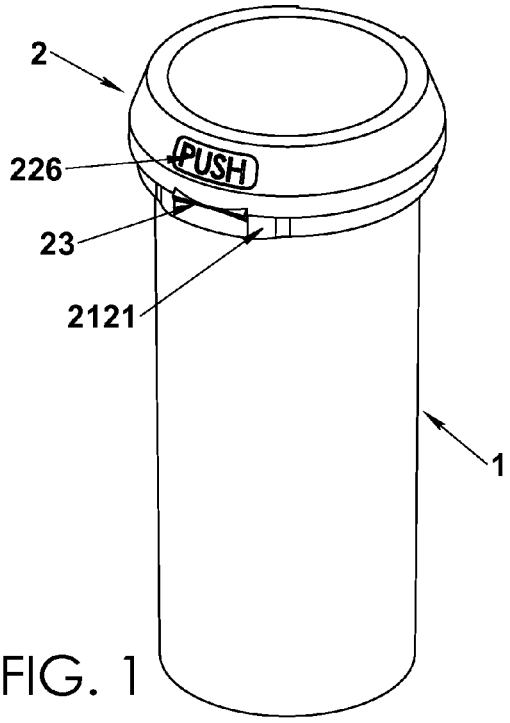
FIG. 1 is a perspective view of a child-resistant container and closure in accordance with the present disclosure showing a closure mounted on an underlying container and suggesting that an adult user can apply pressure on the closure above the hinge, as directed by the instruction panel, to unlock the closure.

In the drawings, preferred embodiments of the invention are illustrated by way of example. Further advantages and features of the invention will be apparent to those skilled in the art from the following detailed description thereof and the accompanying drawings.

It is expressly understood that the description and drawings are illustrative of certain embodiments of the invention, but the invention itself is defined by the accompanying claims.

DETAILED DESCRIPTION

Figure 2:
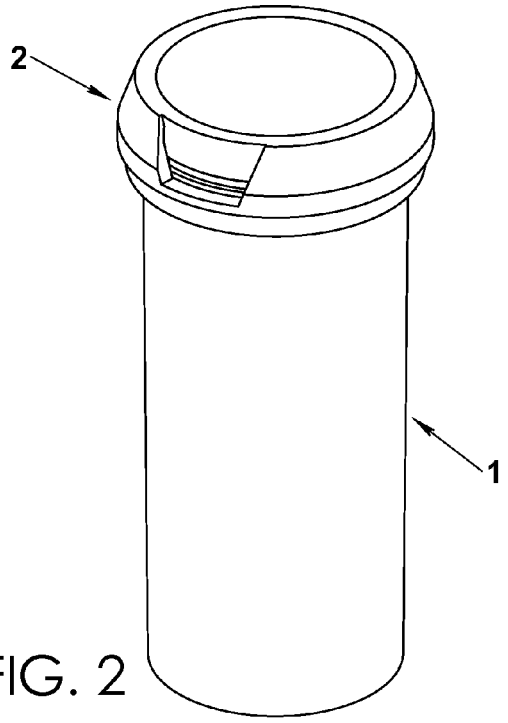
FIG. 2 is another perspective view of the container and closure of FIG. 1 showing the latch side of the locked closure.

As shown in FIGS. 1 & 2, the invention comprises a closure 2 coupled to a container 1, herein embodied as a pill vial, but it is understood that the invention can be embodied using any necked container.

Figure 13:
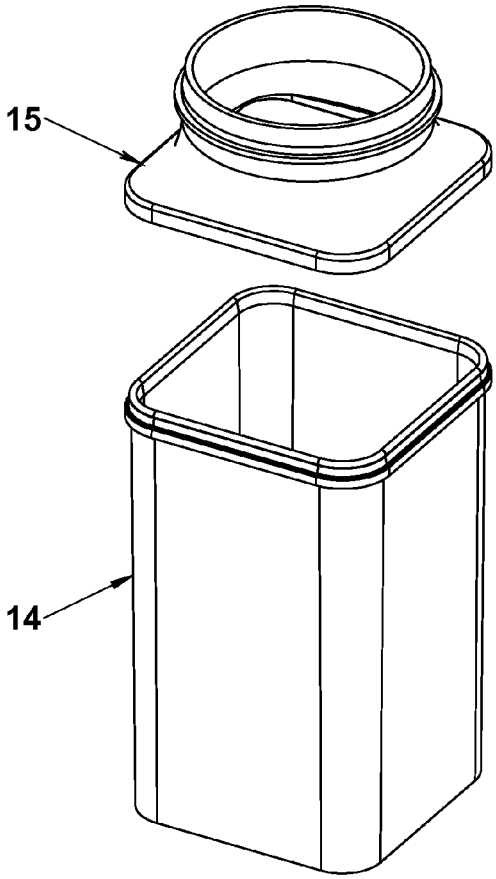
FIG. 13 is perspective view of a non-necked container 14 and neck insert 15.
Figure 14:
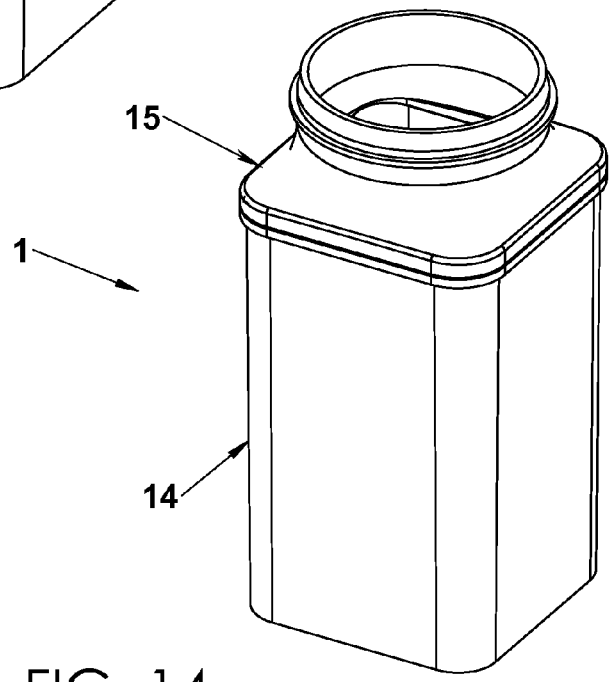
FIG. 14 is a perspective view of a container 1 comprising a non-necked container 14 coupled with a neck insert 15.

In another embodiment of the container 1 as shown in FIG. 13 & 14, the container comprises a non-necked container 14 coupled with a neck insert 15.

Figure 3:
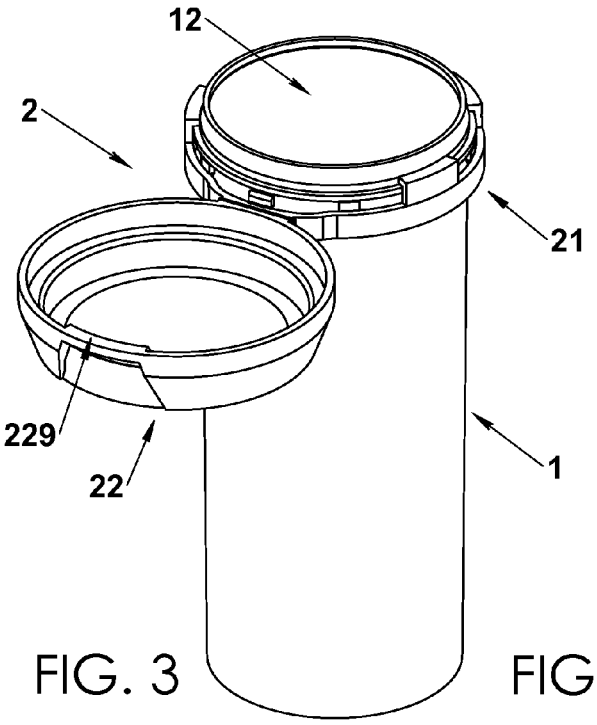
FIG. 3 is another perspective view of the container and closure of FIG. 1 showing the hinge side of the unlocked closure with the lid fully open.
Figure 4:
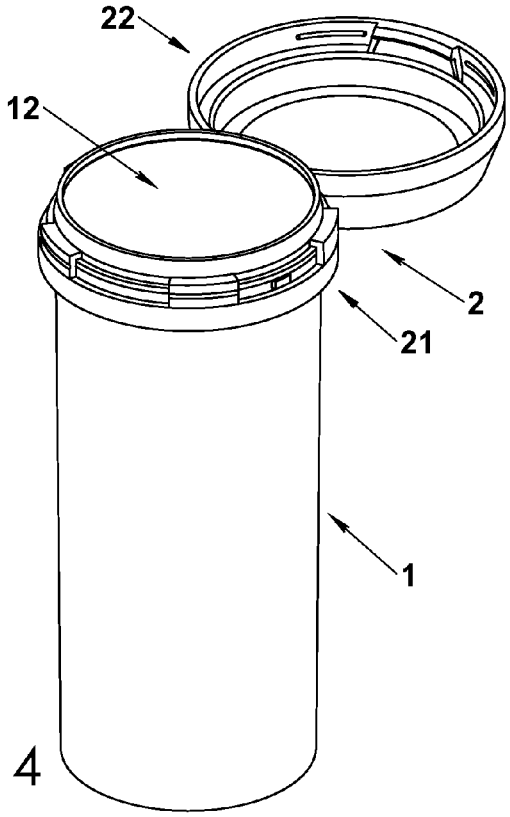
FIG. 4 is another perspective view of the container and closure of FIG. 2 showing the latch side of the unlocked closure with the lid fully open.
Figure 7:
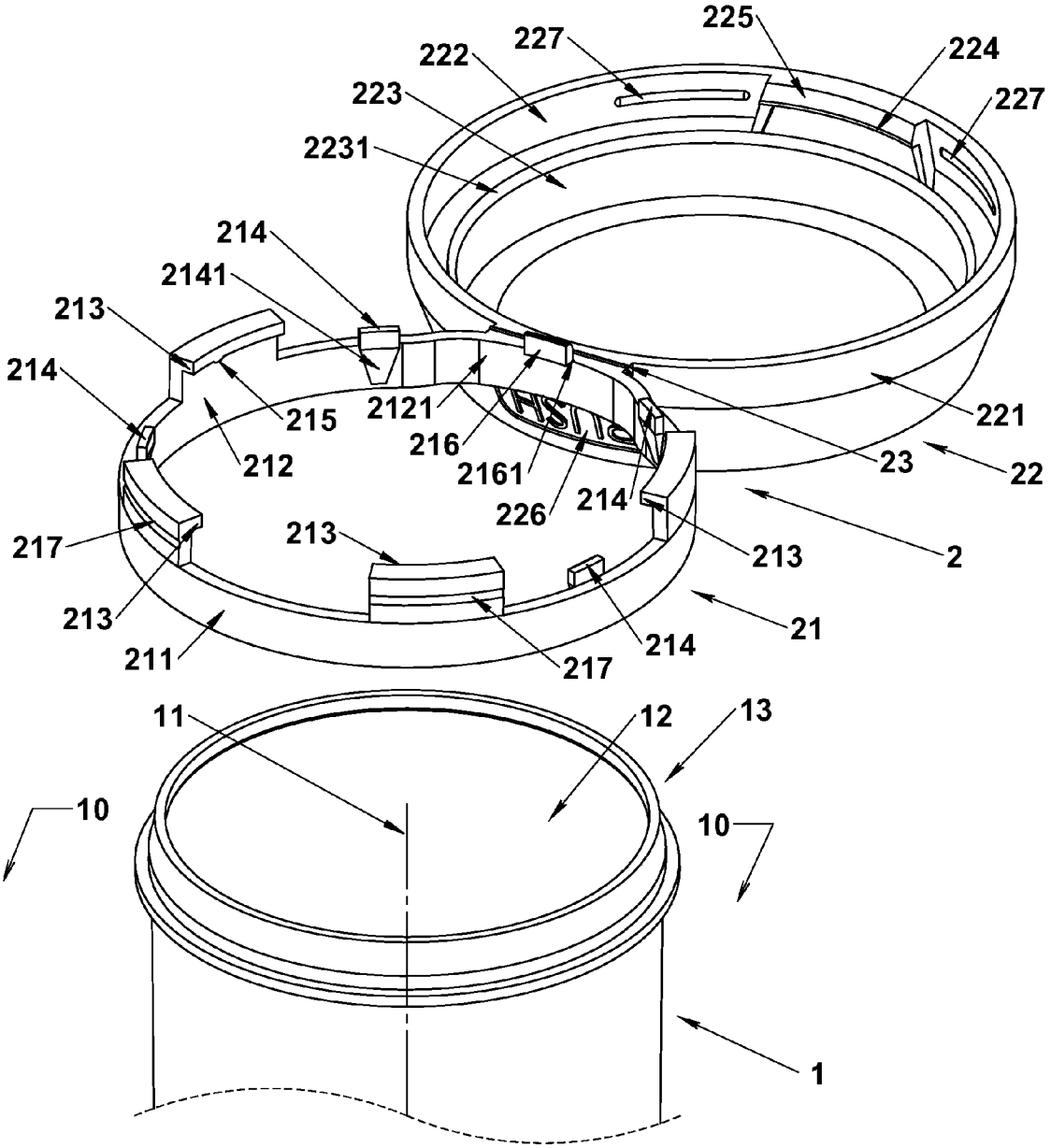
FIG. 7 is a partial perspective view of the container and closure of FIG. 4 showing the neck of the container and an open closure.

As shown in FIGS. 3, 4 & 7, the closure 2 comprises a body 21 and a lid 22 coupled by a hinge 23. In the preferred embodiment, the hinge 23 is a living hinge resulting in a single-piece closure 2.

Figure 5:
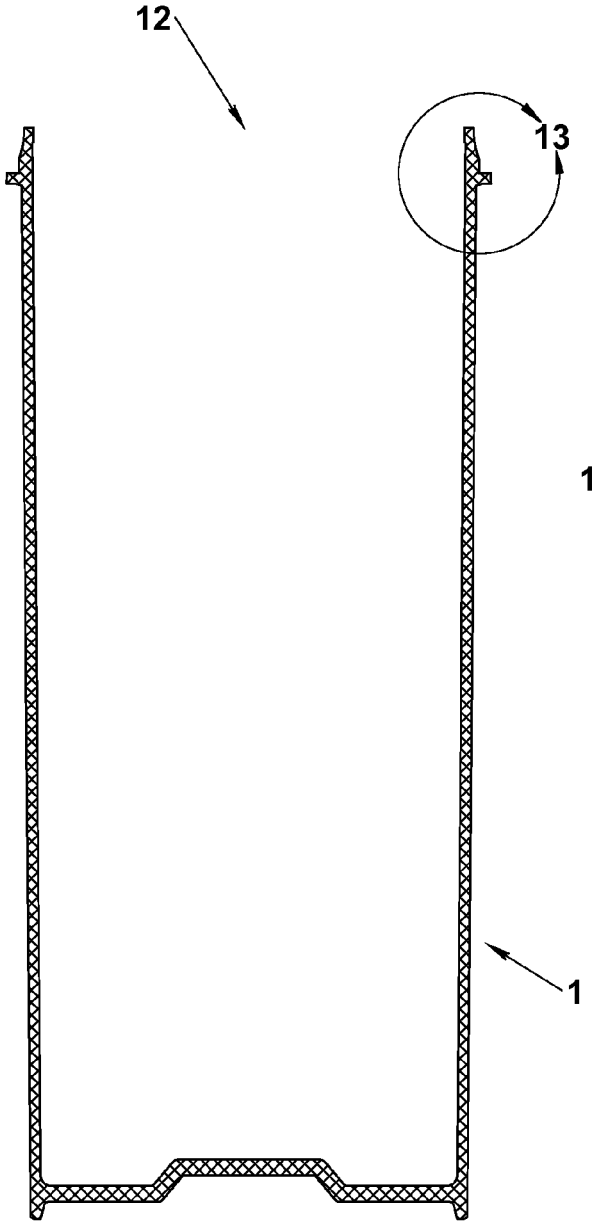
FIG. 5 is a cross-section view of the container through the line 10-10 of FIG. 7.
Figure 6:
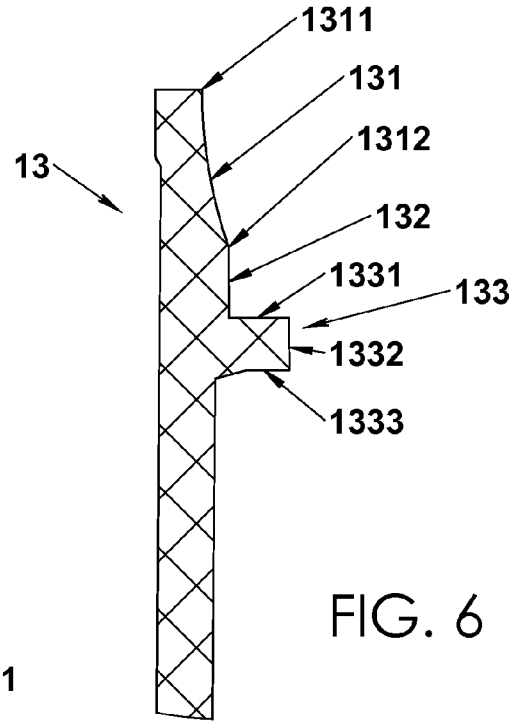
FIG. 6 is a detailed cross-section view of the neck of the container as encircled by line 13 of FIG. 5.

As shown in FIGS. 5 & 6, the container 1 is provided with a generally vertical cylindrical neck 13 surrounding a neck aperture 12. The neck is provided with an annular neck sealing face 131 having an upper edge 1311 and a lower edge 1312 wherein the lower edge diameter 1312 is greater than the upper edge diameter 1311, thereby providing an inclined neck sealing face 131, an annular flange 133 projecting radially from the neck 13 having a generally horizontal upper face 1331, a generally vertical outer face 1332 and a generally horizontal lower face 1333, and a generally vertical neck body-clearance face 132 positioned between the neck sealing face 131 and the flange 133.

As shown in FIG. 7, the body 21 comprises a generally vertical skirt wall sized and shaped to surround the neck 13 and having a body outer face 211 and a body inner face 212.

As shown in FIG. 7, the lid 22 comprises a generally vertical skirt wall having a lid outer face 221 and a lid inner face 222, surmounted by a generally horizontal closing wall, sized and shaped to cooperate with the body 21 to enclose the neck aperture 12.

Figure 8:
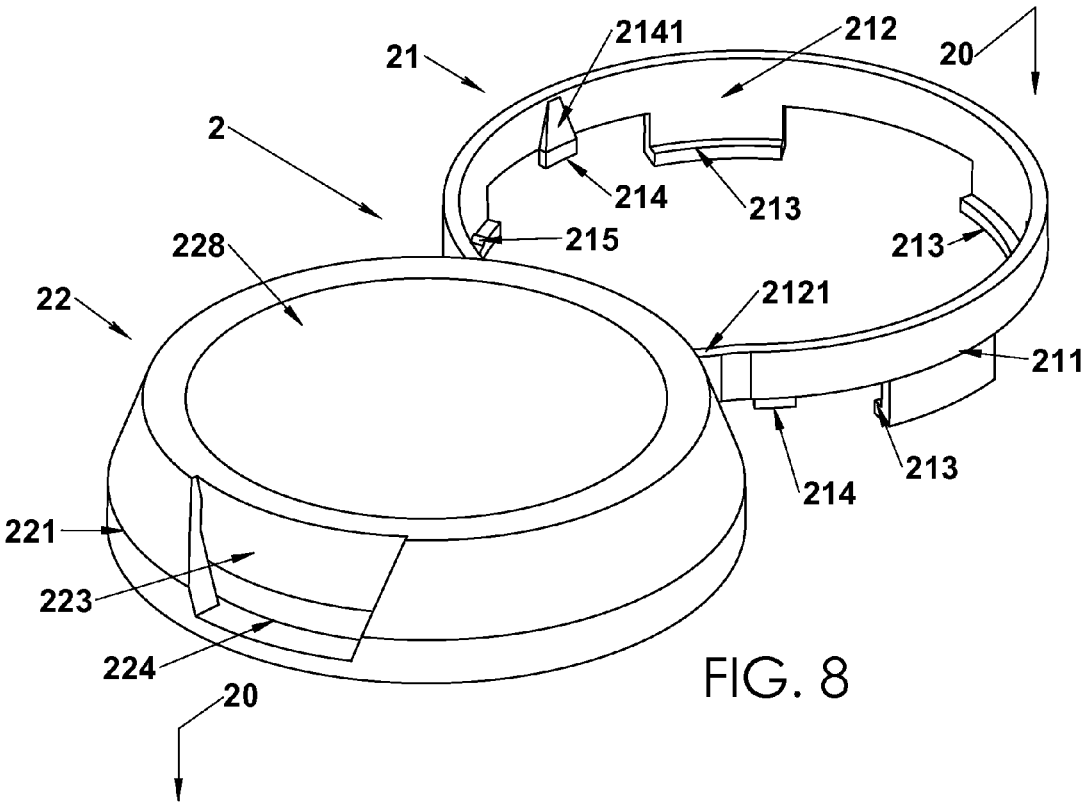
FIG. 8 is a perspective view of the closure with the lid fully open.

As shown in FIGS. 7 & 8, the lid 22 is provided with a latch 224 positioned generally diametrically opposite the hinge 23. The latch 224 is shaped and sized to securely engage the flange 133, thus both locking the lid 22 to the neck 13 and limiting the radial displacement of the closure 2 with respect to the neck 13 in the direction of the hinge 23, while allowing the closure 2 to freely rotate axially about the neck 13.

As shown in FIGS. 1 & 7, the lid 22 is provided with an instruction panel 226 positioned on the lid outer face 221 above the hinge 23. The instruction panel 226 is provided with one or more of: lettering and graphic symbols. In the preferred embodiment, the instruction panel 226 is recessed into the lid outer face 221 and is embossed with the word PUSH, thereby instructing a literate user while also providing a tactile reference point for a visually impaired user.

The closure 2 may selectedly be variously positioned with respect to the coupled container 1, namely: locked wherein the latch 224 is engaged with the flange 133, thus preventing the lid 22 from being rotated about the hinge 23, and unlocked wherein the latch 224 is not engaged with the flange 133, thus allowing the lid 22 to be rotated about the hinge 23 to expose the neck aperture 12.

The lid 22 may selectedly be variously positioned with respect to the body 21, namely: closed wherein the lid 22 is positioned to lie against the body 22, thereby sealing the neck aperture 12, and open wherein the closure 2 is unlocked and the lid 22 has been manually rotated about the hinge 23 to expose the neck aperture 12. It should be noted that when the closure 2 is in the locked position, the lid is in the closed position but cannot be moved to the open position.

As shown in FIGS. 1, 7 & 8, the body 21 is provided with a body offset wall 2121 radially offset from the body inner face 212 such that when the lid 22 is in the closed position, the lid inner face 222 is clear of the nested portion of the body 21.

As shown in FIG. 7, the body 21 is provided with a plurality of circumferentially positioned body upper retainer lugs 213 projecting from the body inner face 212 sized and shaped to lie above a portion of the flange upper face 1331 when coupled to the flange 13, thus preventing the body 21 from being depressed axially with respect to the neck 13. The body upper retainers 213 may also be sized and shaped to provide slip-fit radial contact against the neck body-clearance face 132, thus allowing the closure 2 to freely rotate axially about the neck 13.

Figure 9:
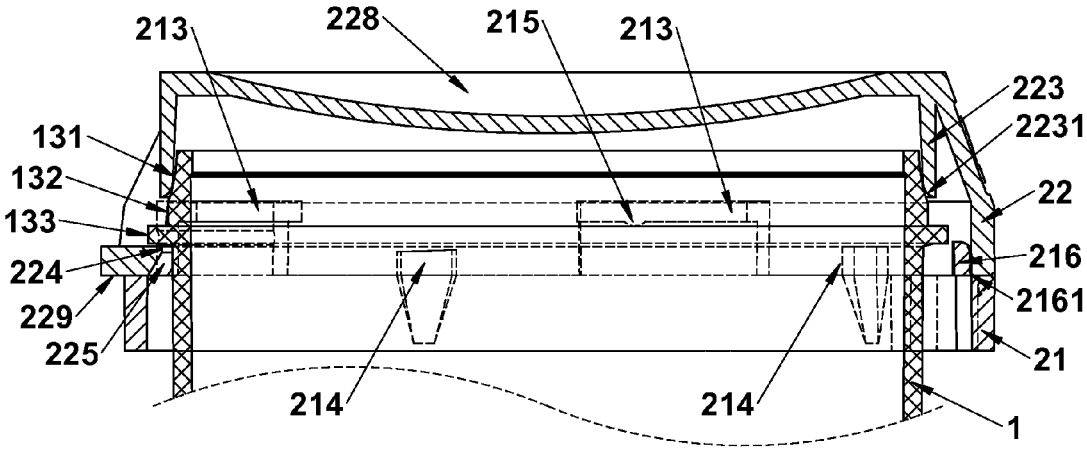
FIG. 9 is a cross-section view through the line 20-20 of FIG. 8 showing the closure in the locked position with the latch fully engaged under the flange, and depicting hidden parts of the container and body with broken lines.

As shown in FIG. 7, the body 21 is provided with a plurality of circumferentially positioned body lower retainer lugs 214 projecting from the body inner face 212 sized and shaped to lie below a portion of the flange lower face 1333 when coupled to the flange 13, thus preventing the body 21 from being lifted axially with respect to the neck 13. The body lower retainers 214 may also be sized and shaped to provide slip-fit radial contact against the neck 13 below the flange 133, thus allowing the closure 2 to freely rotate axially about the neck 13. As shown in FIG. 9, the body lower retainers 214 are provided with a radially inclined face 2141 shaped to facilitate the coupling of the closure 2 to the neck 13.

Figure 10:
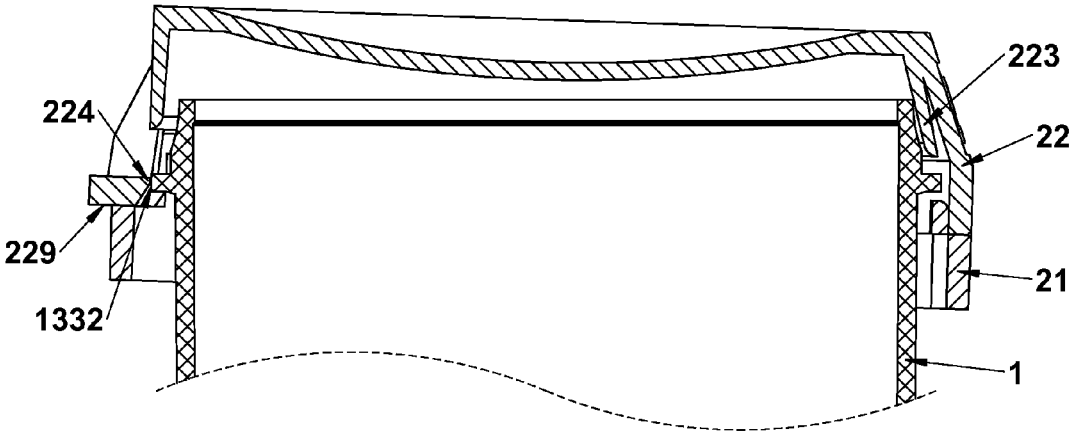
FIG. 10 is a cross-section view through the line 20-20 of FIG. 8 showing the closure fully displaced in the unlocked and closed position with the closure rotated such that the latch edge abuts the flange.
Figure 12:
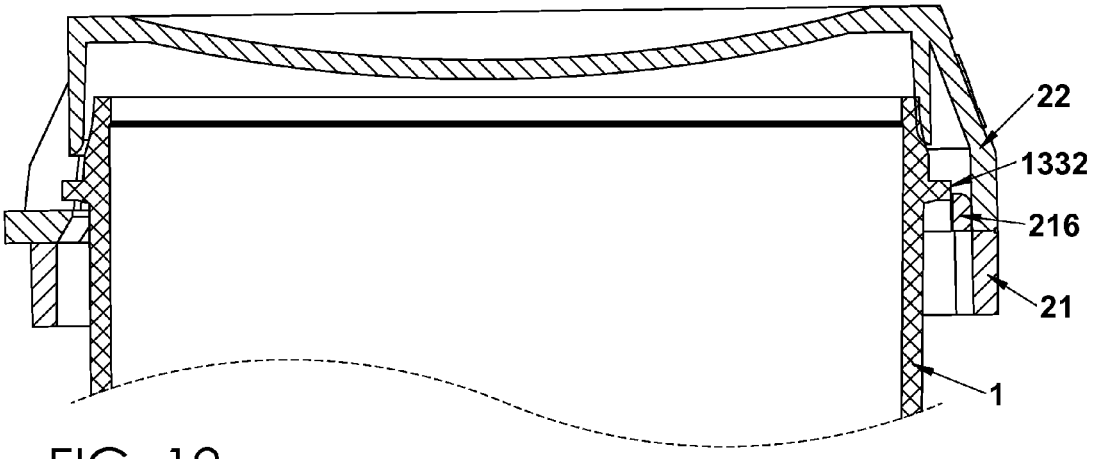
FIG. 12 is a cross-section view through the line 20-20 of FIG. 8 showing the closure lifted such that the interlock interferes with the flange to prevent displacement of the closure.

As shown in FIGS. 7 & 9, the body is provided with body rocker bosses 215 descending from body upper retainers 213 generally centrally positioned between the hinge 23 and the latch 224. When the closure 2 is coupled with the neck 13, the body rockers 215 abut the flange upper face 1331. As shown in FIGS. 10 & 12, the body rockers 215 allow the closure, while not otherwise constrained, to rotate about an axis perpendicular to the axis between the hinge 23 and the latch 224.

As shown in FIG. 7, the lid 22 is provided with a plug 223 that comprises an annular skirt wall descending from the lid 22 that as shown in FIGS. 8 & 9 is terminated by a plug sealing face 2231. The plug 223 is sized and shaped such that the plug sealing face 2231 is able to engage the neck sealing face 131 to provide a secure seal between them, and to be elastically deformed such as to allow the closure 2 to be sufficiently displaced with respect to the neck 13 to disengage the latch 224 from the flange 133. In another embodiment, the plug 223 comprises a solid boss descending from the lid 22.

In the preferred embodiment of the invention, the neck sealing face 131 is positioned on the outer face of the neck 13 with the plug 223 surrounding the neck 13. In another embodiment, the neck sealing face 131 is positioned on the inner face of the neck 13 with the neck 13 surrounding the plug 223. In yet other embodiments, the plug 223 cooperates with a sealing face of a neck insert that may be elastically deformable, coupled to the neck 13.

The body outer face 211 on the side generally opposite the hinge 23 is provided with body grooves 217 that correspond to lid beads 227 projecting from the lid inner face 222 such that when the lid 22 is in the closed position, the lid beads 227 engage the body grooves 217 by snap-fit to maintain the lid 22 in the closed position. Said engagement is only sufficient to resist small opening pressure and is easily defeated by manually lifting the lid 22 when the closure 2 is in the unlocked position.

The closure 2 is coupled by snap-fit to the neck 13 of the container 1 to seal the neck aperture 12. As the closure 2 is pressed axially downward along line 11 of FIG. 7 onto the neck 13 without regard to rotational alignment, the body lower retainers 214 are elastically deformed radially as they engage the flange 133. The snap-fit is facilitated by the wedging action of the inclined face 2141 of the body lower retainers 214 against the flange 133, causing the body lower retainers 214, the body 21 and particularly the body offset wall 2121 to be elastically deformed radially. As shown in FIG. 9, when the closure 2 is fully seated on the neck 13, as limited by the body rockers 215 abutting the flange upper face 1331, the elastically deformed body lower retainers 214 rebound to their original shape, with the body lower retainers 214 now constrained below the flange 133, thus preventing the closure 2 from being disengaged from the neck 13.

The closure 2 is unlocked by applying generally perpendicular pressure on the instruction panel 226 along an axis between the hinge 23 and latch 224 in the direction of the latch 224. The closure 2 is initially displaced with the latch 224 constrained below the flange 133. As shown in FIG. 10, when the edge of the latch 224 clears the flange outer face 1332, the vertical component of the opening pressure causes the closure 2 to rotate about the body rockers 215, as limited by interference between other parts of the body 21 and the flange 133, to the unlocked position wherein the edge of the latch 224 abuts the flange outer face 1332, with the lid 22 remaining in the closed position as restrained by the engagement of the lid beads 227 and body grooves 217.

As shown in FIG. 9, when the lid 22 is in the closed position, the lid outer face 221 overhangs the body outer face 211 to provide a lifting member 229 that projects radially from the lid 22 generally opposite the hinge 23. When the closure 2 is the unlocked position and the lid 22 is in the closed position, the lid 22 can selectedly be manipulated to the open position by upward pressure on the lifting member 229. When the lid 22 is in the locked position, attempting to open the closure 2 by intuitive application of upward pressure on the lifting member 229 cannot disengage the latch 224 from the flange 133. In another embodiment, a portion of the lid 22 is radially extended to increase the overhang of the lifting member 229.

Figure 11:
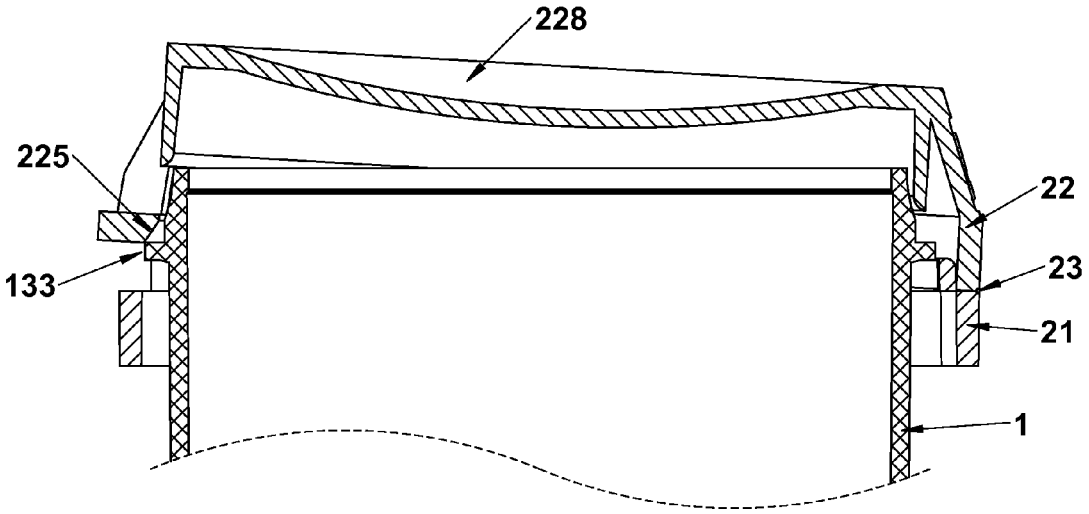
FIG. 11 is a cross-section view through the line 20-20 of FIG. 8 showing the closure in an open position, ready to be locked with the latch about to engage the flange.

When the lid 22 is in the open position, the closure 2 is locked by pressing the lid 22 down against the body 21. As shown in FIG. 11, the latch wedge 225 initially engages the top corner of the flange 133. When as shown in FIG. 10, the lid 22 is further depressed, the pressure of the latch wedge 225 against the flange 133 displaces the closure 2 radially while elastically deforming the plug 223, body lower retainers 214 and body offset wall 2121. When, as shown in FIG. 9, the edge of the latch 224 has passed the flange bottom face 1333, the elastic rebound of the plug 223, body lower retainers 214 and body offset wall 2121 returns the closure 2 to a position concentric with the neck 13, with the latch 224 and flange 133 engaged to securely lock the lid 22. As shown in FIG. 11, the locking of the closure 2 is facilitated by a lid indent 228 that guides the user to press on the center of the lid 22.

To enhance the child-resistance of the closure 2, as shown in FIGS. 7, 9 & 12, the body 21 is provided with an interlock boss 216 projecting from the body inner face 212 below the plane of the flange bottom face 1333 such that if the closure 2 is lifted during opening, as shown in FIG. 12, the interlock 216 engages the flange outer face 1332, thus preventing further radial displacement and the unlocking of the closure 2. The body lower retainers 214 may be shaped to allow the closure 2 to rotate transversely, thus lifting the back of the closure 2 to cause the interlock 216 to more securely engage the flange 133.

The interlock 216 is connected to the body 2 by a frangible interlock joint 2161. The interlock 216 may be removed by breaking the frangible interlock joint 2161, thereby disabling the child-resistance of the closure 2.

The container 1 and closure 2 are manufactured from suitable thermoplastic materials by conventional injection-molding techniques. In other embodiments, the container 1 may be manufactured by blow-molding or other technologies.

Although various preferred embodiments of the present invention have been described herein in detail, it will be appreciated by those skilled in the art that variations may be made thereto without departing from the spirit of the invention or the scope of the appended claims.

The invention claimed is:

1. An assembly comprising: a closure coupled to a container; wherein the container is provided with a container neck terminated by a filling aperture to its interior space; and wherein the container is provided with an annular flange projecting from the container neck; and wherein the closure is provided with a plurality of retainer lugs positioned above and below the flange to prevent the closure from being disengaged from the container once coupled; and wherein the closure has limited freedom to be displaced radially with respect to the container; and wherein the closure is provided with a lid hinged to a closure body to cover the aperture of the container; and wherein the lid is provided with a latch that is able to securely engage the flange; and wherein the lid can selectedly be rotationally positioned about the hinge such that the latch engages the flange, thereby locking the closure; and wherein the closure can selectedly be displaced radially with respect to the container to disengage the latch from the flange, thereby unlocking the closure.

2. An assembly of claim 1 where the container neck and closure are concentric, thereby allowing the closure to rotate about the container neck.

3. A closure of claim 1 wherein one or more spring members are provided to hold the closure in a predetermined position with respect to the container.

4. A closure of claim 1 wherein one or more spring members are provided to exert pressure radially between the closure and container such that the radial engagement of the latch with the flange is maintained.

5. A closure of claim 1 wherein one or more guiding members are provided to confine a radial displacement of the closure to a single axis with respect to the container.

6. A closure of claim 1 wherein a spring member is provided to exert axial pressure on the lid when the latch is engaged with the flange, with an axial pressure acting to maintain the axial engagement of the latch with the flange.

7. A closure of claim 1 wherein the lid is provided with one or more descending wedges positioned below the latch such that during rotation of the lid to position the latch to engage the flange, the wedges engage the flange to first force the closure to be radially displaced with respect to the container to allow the latch to pass the flange.

8. A closure of claim 1 wherein the closure is provided with one or more inwardly protruding interlock bosses that engage the flange to prevent further radial displacement of the closure if the closure is lifted axially while being displaced radially, thereby enhancing the child-resistance of the assembly.

9. An interlock boss of claim 8 wherein the interlock boss is connected to the closure by a frangible joint such that the interlock boss may be removed by breaking said joint.

10. A closure of claim 1 wherein the closure body is provided with descending rocker bosses positioned to engage the flange such that the closure, when not otherwise constrained, is free to rotate about the axis between the rockers.

11. A closure of claim 1 wherein the lid is provided with a lifting member positioned generally opposite the hinge.

12. An assembly of claim 1 wherein the container neck and lid are provided with cooperating sealing members to create a seal between them, and wherein one or more of the sealing members can be elastically deformed sufficiently to allow displacement of the closure with respect to the container, to disengage the latch from the flange.

13. A closure of claim 1 wherein the lid and closure body are provided with mutually cooperating beads and grooves that selectedly snap-lock and unlock the lid to and from a closed position against the closure body.

14. A closure of claim 1 wherein the closure is marked to provide directive operational instruction by one or more of: lettering and graphic symbols.

15. A closure of claim 1 wherein the lid is provided with an indent or ring to indicate location for application of closing pressure on the lid, comprising one or more of: a central depression, an annular groove and an annular bead.

16. A closure of claim 15 wherein the indent or ring is marked to provide directive operational instruction by one or more of: lettering and graphic symbols.

* * * * *